US011241600B2

(12) United States Patent
Huotari

(10) Patent No.: US 11,241,600 B2
(45) Date of Patent: Feb. 8, 2022

(54) SUPPRESSION UNIT, NOZZLE FOR SUPPRESSION UNIT, AND METHOD

(71) Applicants: Marioff Corporation Oy, Vantaa (FI); Arto Huotari, Helsinki (FI)

(72) Inventor: Arto Huotari, Helsinki (FI)

(73) Assignee: MARIOFF CORPORATION OY, Vantaa (FI)

( * ) Notice: Subject to any disclaimer, the term of this patent is extended or adjusted under 35 U.S.C. 154(b) by 188 days.

(21) Appl. No.: 15/766,190

(22) PCT Filed: Oct. 6, 2015

(86) PCT No.: PCT/FI2015/050668
§ 371 (c)(1),
(2) Date: Apr. 5, 2018

(87) PCT Pub. No.: WO2017/060556
PCT Pub. Date: Apr. 13, 2017

(65) Prior Publication Data

US 2018/0280745 A1 Oct. 4, 2018

(51) Int. Cl.
*A62C 37/09* (2006.01)
*B05B 15/40* (2018.01)
(Continued)

(52) U.S. Cl.
CPC ..... *A62C 37/09* (2013.01); *A62C 31/005* (2013.01); *B05B 15/40* (2018.02); *B05B 1/14* (2013.01)

(58) Field of Classification Search
CPC ..... A62C 37/09; A62C 31/005; B05B 15/40; B05B 1/14
(Continued)

(56) References Cited

U.S. PATENT DOCUMENTS 2,009,478 A * 7/1935 Coles ..... B05B 3/0404 239/230
2,051,287 A * 8/1936 Buckner ..... B05B 3/0422 239/230
(Continued)

FOREIGN PATENT DOCUMENTS

CN 1243446 A 2/2000
CN 2865861 Y 2/2007
(Continued)

OTHER PUBLICATIONS

European Search Report for application EP 15784072.9, dated Jan. 17, 2020, 19 pages.
(Continued)

*Primary Examiner* — Chee-Chong Lee
(74) *Attorney, Agent, or Firm* — Cantor Colburn LLP

(57) ABSTRACT

A suppression unit includes a nozzle, an actuator piston, a casing, and a biasing device. The nozzle has an exterior surface, an interior bore extending along a longitudinal axis, and a plurality of discharge orifices passing from the interior bore to the exterior surface. The actuator piston includes an interior channel in fluid communication with the interior bore, the nozzle separably attached to the actuator piston. The actuator piston and the nozzle are disposed within the casing and the biasing device is compressible between the actuator piston and the casing. The discharge orifices are protected by the casing in a biased passive condition of the nozzle, and the discharge orifices are moved longitudinally out of the casing in an active condition of the nozzle.

4 Claims, 7 Drawing Sheets

(51) Int. Cl.
*A62C 31/00* (2006.01)
*B05B 1/14* (2006.01)

(58) Field of Classification Search
USPC ..... 169/37
See application file for complete search history.

(56) References Cited

U.S. PATENT DOCUMENTS

| | | | | |
|---|---|---|---|---|
| 2,221,878 | A * | 11/1940 | Nelson | B05B 3/0422 239/206 |
| 2,493,982 | A | 1/1950 | Lee | |
| 3,291,216 | A | 12/1966 | Edward | |
| 3,464,628 | A * | 9/1969 | Ho | B05B 3/08 239/97 |
| 3,521,822 | A * | 7/1970 | Friedman | F16L 55/00 239/206 |
| 3,526,363 | A * | 9/1970 | Hauser | B05B 3/0404 239/206 |
| 3,655,132 | A * | 4/1972 | Rosic | B05B 15/70 239/206 |
| 3,848,675 | A | 11/1974 | Evans | |
| 3,940,066 | A | 2/1976 | Hunter | |
| 4,015,665 | A | 4/1977 | Simons et al. | |
| 4,171,775 | A * | 10/1979 | Unruh | B05B 3/0422 239/206 |
| 4,214,631 | A | 7/1980 | Hattori | |
| 4,253,608 | A | 3/1981 | Hunter | |
| 4,625,914 | A | 12/1986 | Sexton et al. | |
| 4,634,052 | A | 1/1987 | Grizzle et al. | |
| 4,977,963 | A | 12/1990 | Simons | |
| 4,986,474 | A | 1/1991 | Schisler et al. | |
| 5,058,806 | A | 10/1991 | Rupar | |
| 5,292,071 | A | 3/1994 | Kruer | |
| 6,000,632 | A | 12/1999 | Wallace | |
| 6,651,905 | B2 | 11/2003 | Sesser et al. | |
| 6,732,950 | B2 | 5/2004 | Ingham, Jr. et al. | |
| 7,040,259 | B2 | 5/2006 | Sundholm | |
| 7,146,938 | B2 | 12/2006 | Sundholm | |
| 7,516,800 | B1 | 4/2009 | Silva, Jr. et al. | |
| 7,644,870 | B2 | 1/2010 | Alexander et al. | |
| 7,686,236 | B2 | 3/2010 | Alexander | |
| 8,181,889 | B2 | 5/2012 | Shahak | |
| 8,225,881 | B2 | 7/2012 | Silva, Jr. | |
| 8,528,653 | B1 | 9/2013 | Silva, Jr. et al. | |
| 2005/0224240 | A1 | 10/2005 | Cosgrove | |
| 2008/0060216 | A1 | 3/2008 | Reilly et al. | |
| 2012/0285707 | A1 | 11/2012 | Kameishi et al. | |
| 2013/0068848 | A1 | 3/2013 | Schultheis | |
| 2018/0296867 | A1 | 10/2018 | Huotari | |

FOREIGN PATENT DOCUMENTS

| | | | |
|---|---|---|---|
| CN | 101822882 | A | 9/2010 |
| CN | 201823211 | U | 5/2011 |
| CN | 102240428 | A | 11/2011 |
| CN | 102441246 | B | 5/2012 |
| CN | 103071268 | A | 5/2013 |
| KR | 20110009907 | A | 1/2011 |
| KR | 101516282 | | 5/2015 |
| KR | 101533759 | | 7/2015 |
| RU | 2015737 | C1 | 7/1994 |
| WO | 2005102461 | A1 | 11/2005 |

OTHER PUBLICATIONS

International Search Report and Written Opinion for Application PCT/FI2015/050669, dated May 13, 2016, 9 pages.
Singapore Written Opinion for application SG 11201802308P, dated Aug. 8, 2019, 7 pages.
Russian Office Action for application 2018111257, dated Apr. 23, 2019, 7 pages.
International Search Report and Written Opinion for application PCT/FI2015/050668, 10 pages.
U.S. Non Final Office Action U.S. Appl. No. 15/765,772, dated Mar. 5, 2020, 27 pages.
Chinese Office Action for application CN 201580083652.9, dated Jan. 6, 2020, 9 pages.
2nd Chinese Office Action for Application No. 201580083652.9; dated Aug. 13, 2020; 12 Pages (with English Translation).
Xiuqiao, Huang; Handbook "Research and Practice of Sprinkler Irrigation Technology", Yellow River Waster Conservancy Press, Dec. 31, 2018, 3 Pages.

* cited by examiner

SUPPRESSION UNIT, NOZZLE FOR SUPPRESSION UNIT, AND METHOD

BACKGROUND

Spraying apparatuses include a nozzle arranged to deliver a spray of fluidic material through discharge orifices to a surrounding environment, such as for fire-fighting. Some nozzles are received in fixed nozzle adapters and remain in the same position when utilized and not utilized. Such nozzles may be employed when discharge orifice protection is not required. Other nozzles are "pop out" nozzles that are arranged to move between passive and active states. The nozzle is positioned in a retracted position when in an inactive or passive state. In an active state, the nozzle is in an extended position such that at least one of the discharge orifices is exposed to deliver a spray of fluidic material.

The pop-out nozzle is biased in the retracted position by a spring included with the nozzle construction. That is, the nozzle itself includes a shoulder that directly engages with the spring during activation. Because the spring is compressed by the shoulder of the nozzle, the nozzle itself serves as a piston for the spraying apparatus.

ISO 15371 applies to the design, testing, and operation of pre-engineered fire extinguishing systems to protect galley hoods, ducts, fryers and other grease laden appliances. The standard requires that nozzles be approved for their intended use and be provided with caps or other suitable devices to prevent the entrance of grease vapors, moisture, or other foreign materials into the piping. While the fixed nozzle does not provide the necessary protection for the discharge orifices, the pop-out nozzle may protect the orifices in the retracted state of the nozzle. Other means to protect the discharge orifices has been the blow off cap as suggested by standard. However, if the system is activated, then the caps are blown off and have to be manually re-installed. In real applications, the nozzles are not accessible without excessive effort thus replacing the caps is very much of a challenge.

Accordingly, there exists a need in the art for a water mist spraying apparatus in which a type approved nozzle can be installed in a way that the discharge orifices of the type approved nozzle are protected.

BRIEF DESCRIPTION

A suppression unit includes a nozzle, an actuator piston, a casing, and a biasing device. The nozzle has an exterior surface, an interior bore extending along a longitudinal axis, and a plurality of discharge orifices passing from the interior bore to the exterior surface. The actuator piston includes an interior channel in fluid communication with the interior bore, the nozzle separably attached to the actuator piston. The actuator piston and the nozzle are disposed within the casing and the biasing device is compressible between the actuator piston and the casing. The discharge orifices are protected by the casing in a biased passive condition of the nozzle, and the discharge orifices are moved longitudinally out of the casing in an active condition of the nozzle.

In addition to one or more of the features described above or below, or as an alternative, further embodiments could include the actuator piston including an exterior surface having a first shoulder, and the casing including an interior surface having a second shoulder, a first end of the biasing device may be operatively engaged with the first shoulder, and a second end of the biasing device may be operatively engaged with the second shoulder.

In addition to one or more of the features described above or below, or as an alternative, further embodiments could include the casing including a protection portion operatively arranged to block the discharge orifices in the passive condition of the nozzle, the second shoulder disposed between a first end and a second end of the casing, and the protection portion disposed between the second shoulder and the second end of the casing.

In addition to one or more of the features described above or below, or as an alternative, further embodiments could include an O-ring seal between the protection portion of the casing and the nozzle.

In addition to one or more of the features described above or below, or as an alternative, further embodiments could include the biasing device being a spring.

In addition to one or more of the features described above or below, or as an alternative, further embodiments could include the spring made of stainless steel.

In addition to one or more of the features described above or below, or as an alternative, further embodiments could include the spring concentrically surrounding a portion of the actuator piston and a portion of the nozzle.

In addition to one or more of the features described above or below, or as an alternative, further embodiments could include an inlet portion, the inlet portion having a fluid passageway in communication within the interior channel of the actuator piston and the interior bore of the nozzle, the inlet portion further including a receiving section, a first portion of the casing receivable within the receiving section.

In addition to one or more of the features described above or below, or as an alternative, further embodiments could include the nozzle threadably attached to the actuator piston.

In addition to one or more of the features described above or below, or as an alternative, further embodiments could include the nozzle including a shoulder, an end of the actuator piston adjacent the shoulder of the nozzle.

In addition to one or more of the features described above or below, or as an alternative, further embodiments could include an O-ring seal between the end of the actuator piston and the shoulder of the nozzle.

In addition to one or more of the features described above or below, or as an alternative, further embodiments could include the nozzle including a filter having inlets to fluidically communicate the interior channel of the actuator piston to the interior bore of the nozzle, and the interior channel including an annular space between the filter and an interior surface of the actuator piston.

In addition to one or more of the features described above or below, or as an alternative, further embodiments could include the discharge orifices located in a discharge area of the nozzle and the discharge area slidable within a protection portion of the casing, the discharge area having approximately same outer dimensions as inner dimensions of the protection portion.

A nozzle includes a nozzle body having a first end and a second end, an exterior surface, an interior bore extending along a longitudinal axis, a shoulder, a plurality of discharge orifices passing from the interior bore to the exterior surface in a discharge area of the nozzle body, the discharge area disposed between the second end and the shoulder, and a threaded area on the exterior surface, the threaded area disposed between the first end and the shoulder; and, a filter at the first end of the nozzle body, the filter including inlets to the interior bore; wherein the exterior surface in the discharge area has a substantially constant outer diameter along the longitudinal axis.

In addition to one or more of the features described above or below, or as an alternative, further embodiments could include a circumferential O-ring receiving indent in the nozzle body between the shoulder and the discharge area.

In addition to one or more of the features described above or below, or as an alternative, further embodiments could include an O-ring receiving area on the exterior surface of the nozzle body between the shoulder and the threaded area.

A method of employing a nozzle within a suppression unit, the suppression unit including the nozzle having an exterior surface, an interior bore extending along a longitudinal axis, and a plurality of discharge orifices passing from the interior bore to the exterior surface; an actuator piston having an interior channel in fluid communication with the interior bore, the nozzle separably attached to the actuator piston; a casing, the actuator piston and the nozzle disposed within the casing; and a biasing device compressible between the actuator piston and the casing, the method including protecting the discharge orifices with the casing in a biased passive condition of the nozzle, and moving the discharge orifices longitudinally out of the casing in an active condition of the nozzle.

In addition to one or more of the features described above or below, or as an alternative, further embodiments could include sealing the exterior surface of the nozzle to an interior surface of the casing upstream of the discharge orifices.

In addition to one or more of the features described above or below, or as an alternative, further embodiments could include threading the nozzle to the actuator piston within the casing.

In addition to one or more of the features described above or below, or as an alternative, further embodiments could include encircling portions of both the nozzle and the actuator piston with the biasing device.

BRIEF DESCRIPTION OF THE DRAWINGS

The subject matter, which is regarded as the present disclosure, is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Figure 1:
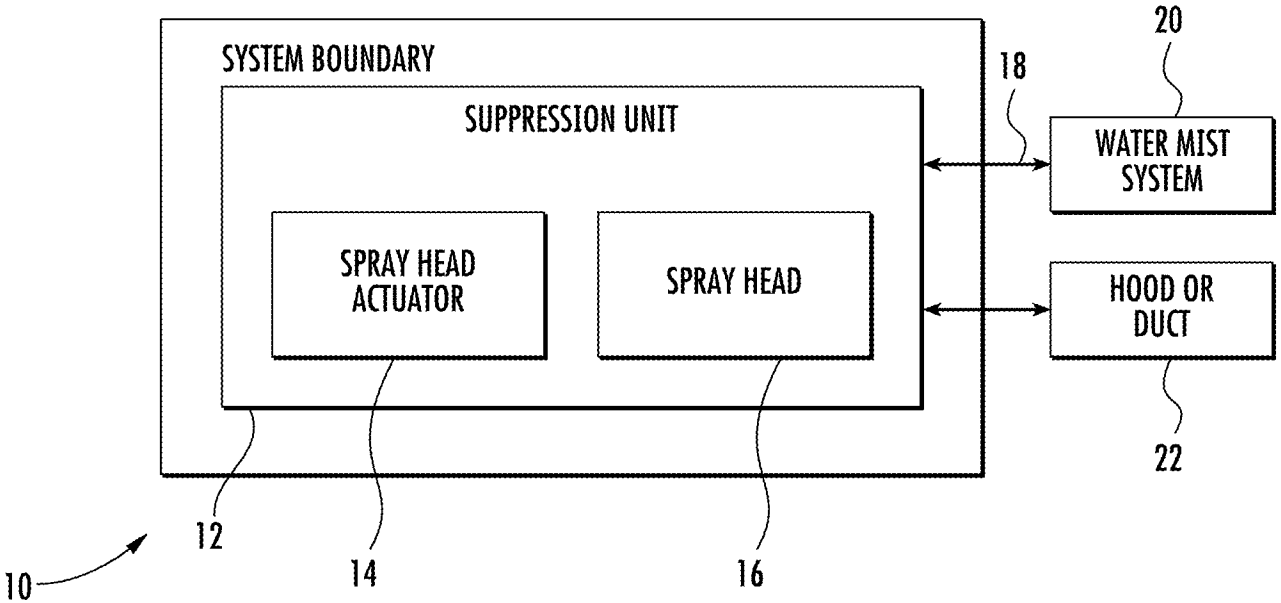
FIG. 1 is a block diagram of an embodiment of a suppression system.

FIG. 1 shows a block diagram of an embodiment of a fire suppression system 10. The system 10 includes a fire suppression unit 12 including an actuator piston 14 and a nozzle 16 (a spray head). While connected to the actuator piston 14, the nozzle 16 is separable from the actuator piston 14 and thus the nozzle 16 can be utilized as a fixed, non-actuatable nozzle in other embodiments. The fire suppression unit 12 receives a fluid for activating the actuator piston 14 to move the nozzle 16 from a retracted position (passive condition) to an extended position (active condition). In one embodiment, the fluid 18 is from a water mist system 20. That is, the fluid 18 may be water which, due to high pressure, is then atomized into water mist. However, the fluid 18 is not limited to water and water mist, but may additionally or alternatively include additives, foam agent, or any other suppression agent deemed suitable for the intended purpose. Also in one embodiment, the fire suppression system 10 is incorporable in a hood or duct 22, although other uses of the fire suppression system 10 are within the scope of these embodiments.

Figure 2:
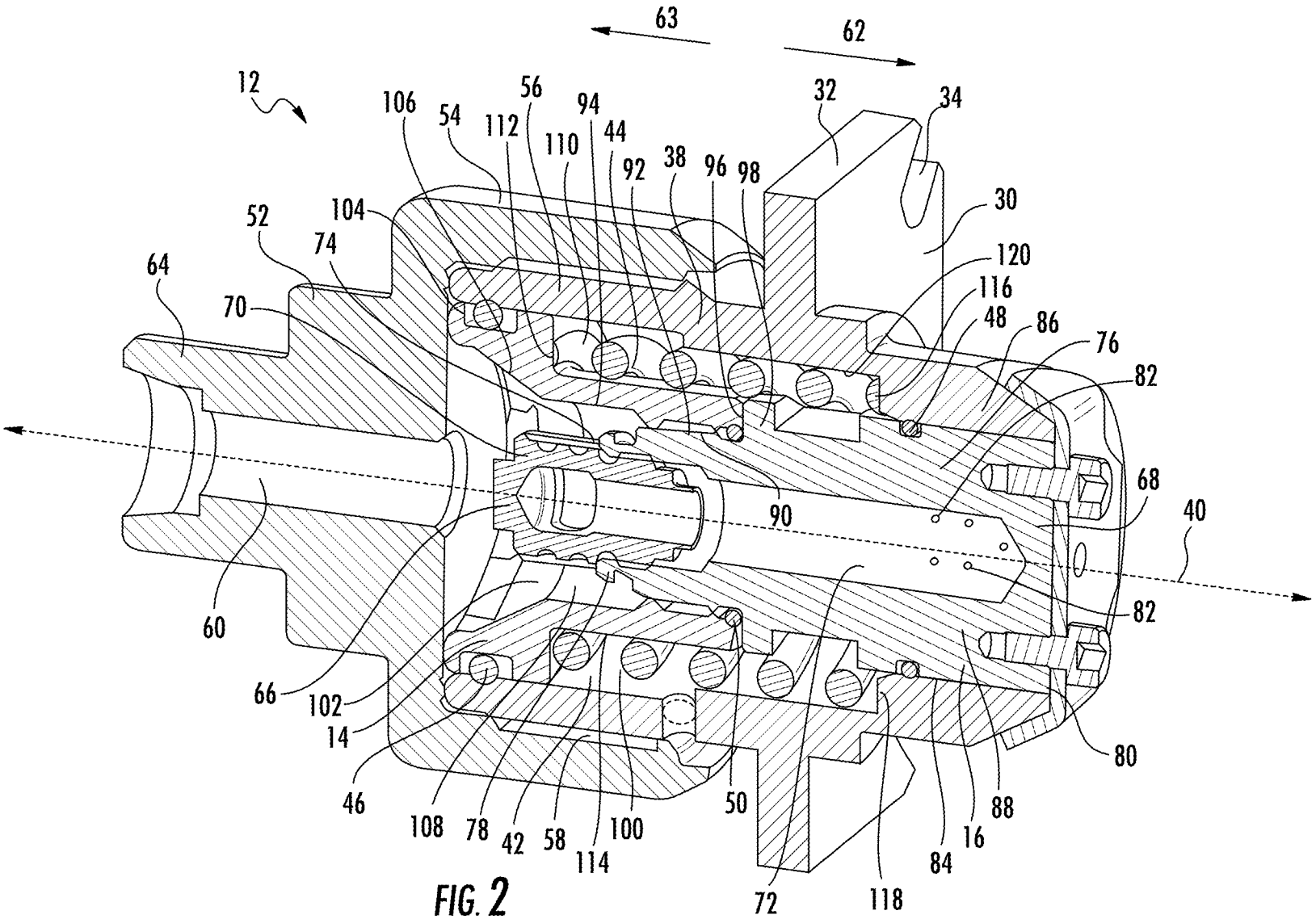
FIG. 2 is perspective sectional view of one embodiment of a suppression unit, depicted in a passive condition, for the suppression system of FIG. 1
Figure 3:
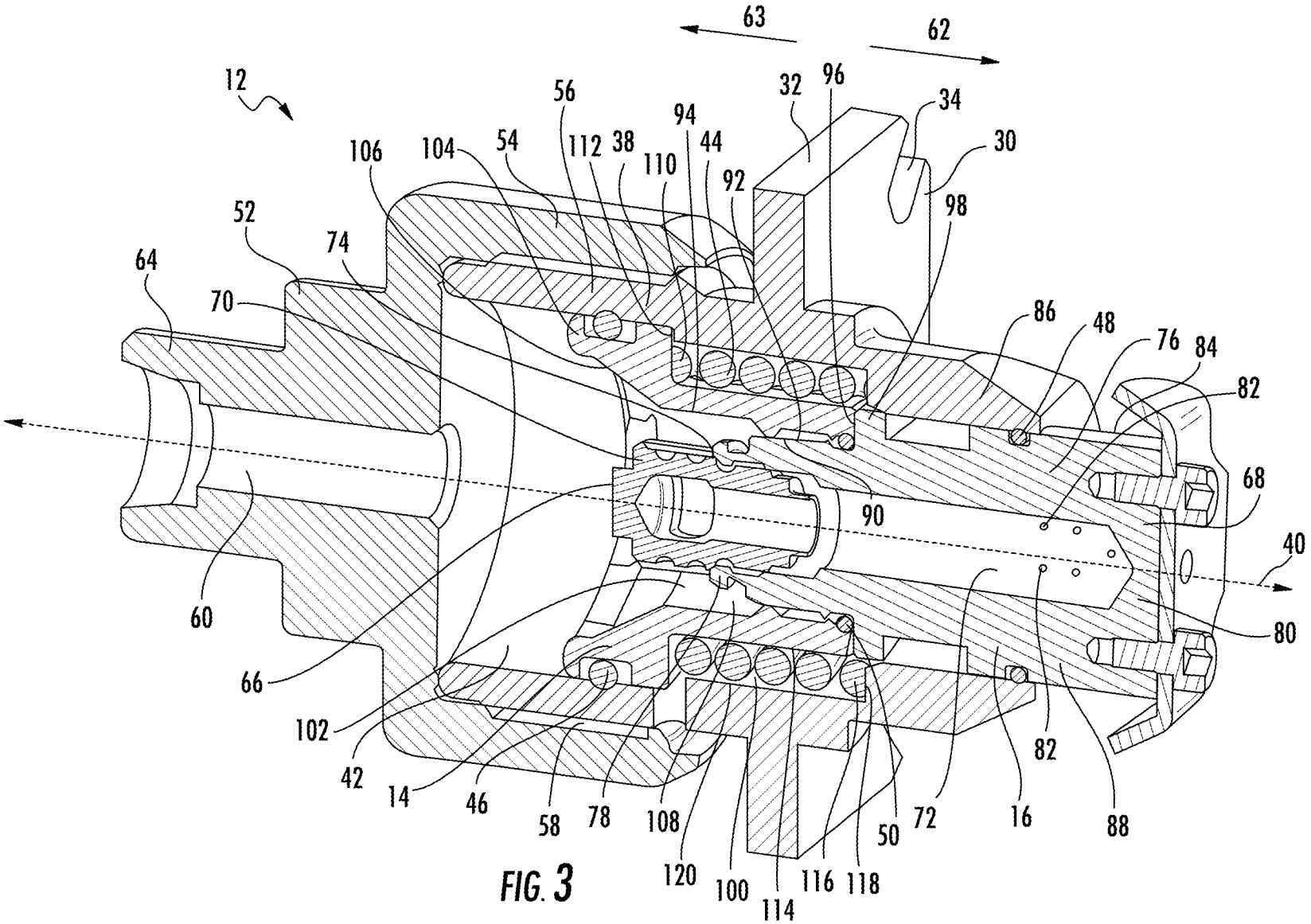
FIG. 3 is a perspective sectional view of the suppression unit, depicted in an active condition.
Figure 4:
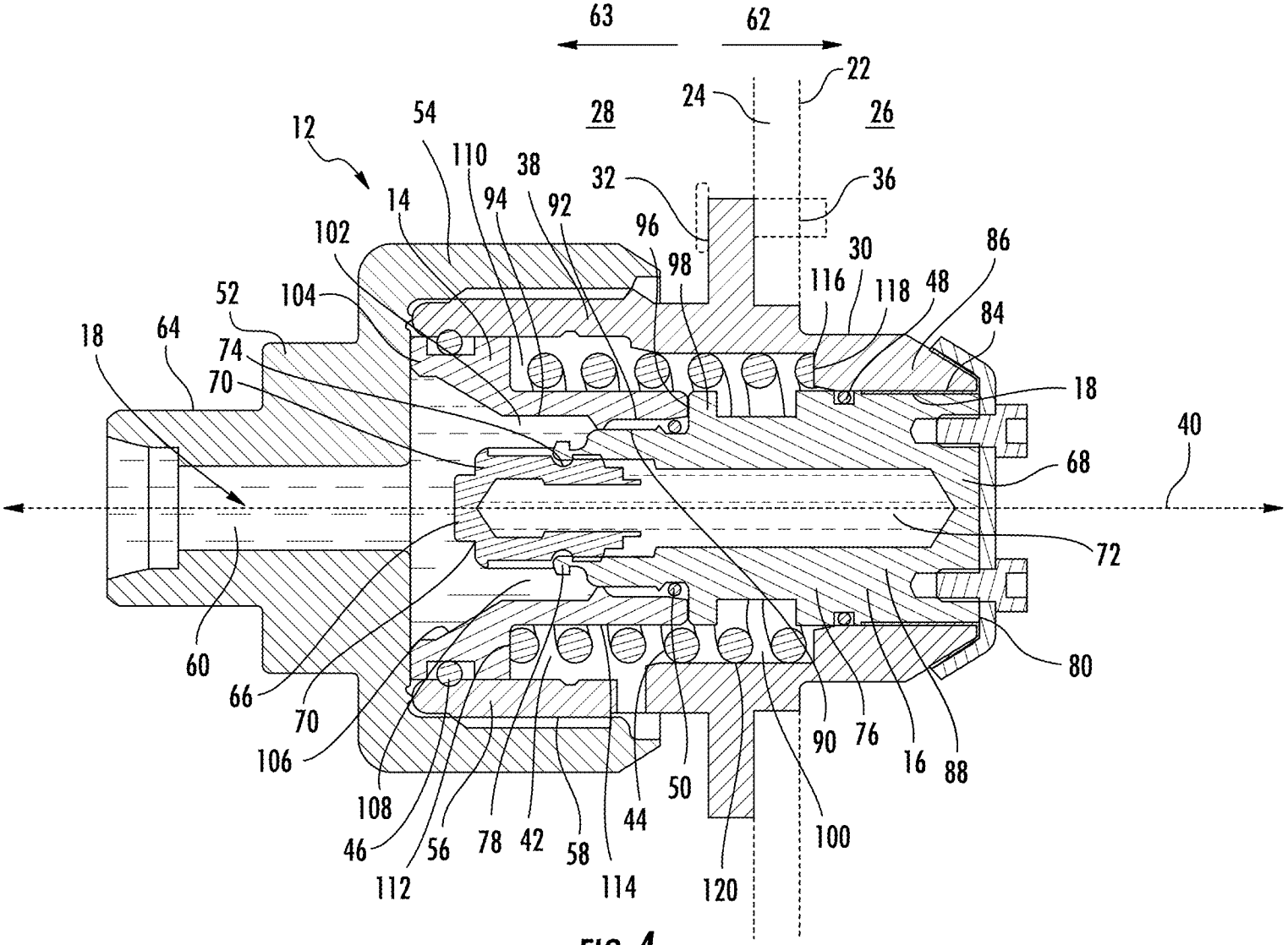
FIG. 4 is a side sectional view of the suppression unit, depicted in the passive condition with an introduction of fluid therein.
Figure 5:
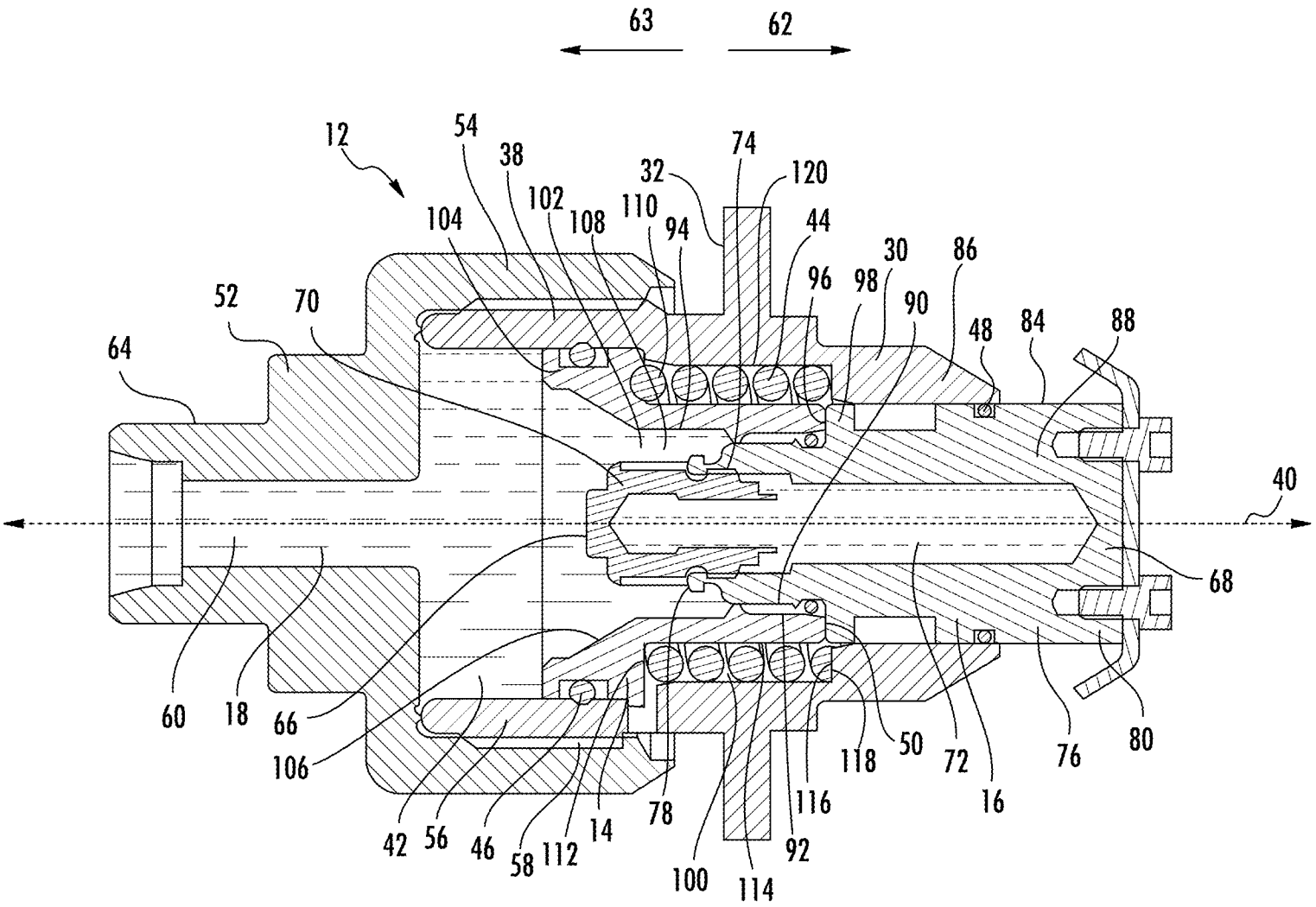
FIG. 5 is a side sectional view of the suppression unit, depicted in the active condition after the introduction of a fluid therein.
Figure 6:
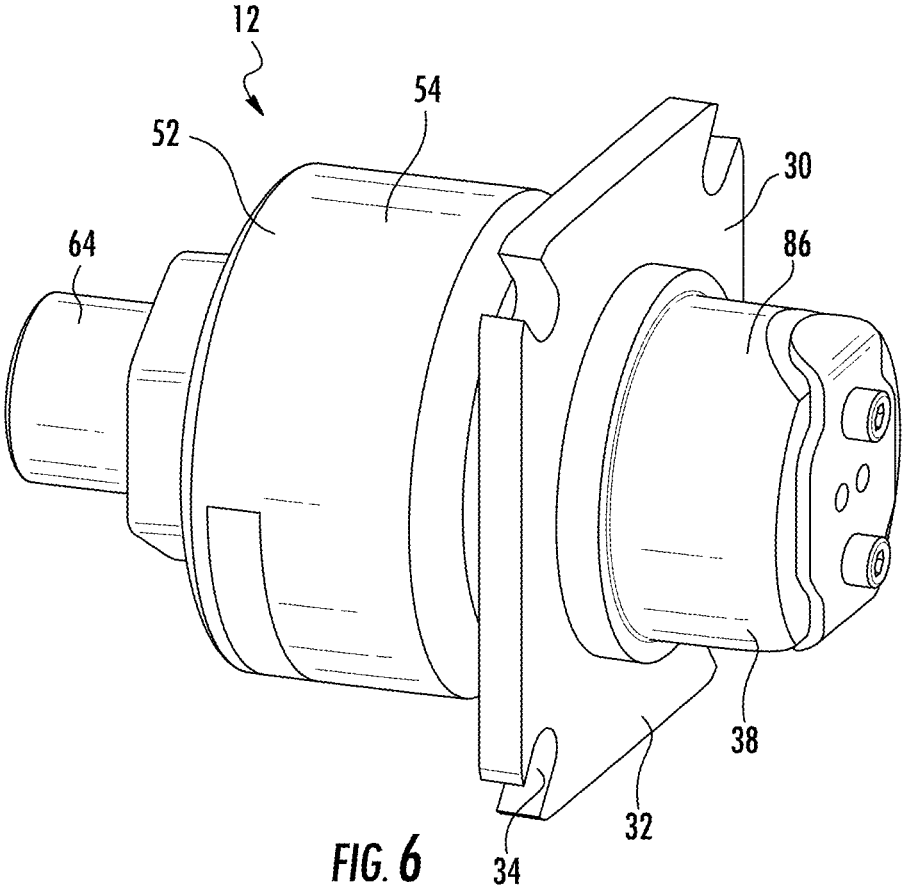
FIG. 6 is a perspective view of the suppression unit, depicted in the passive condition; and, FIG. 7 is a perspective view of the suppression unit, depicted in the active condition.
Figure 7:
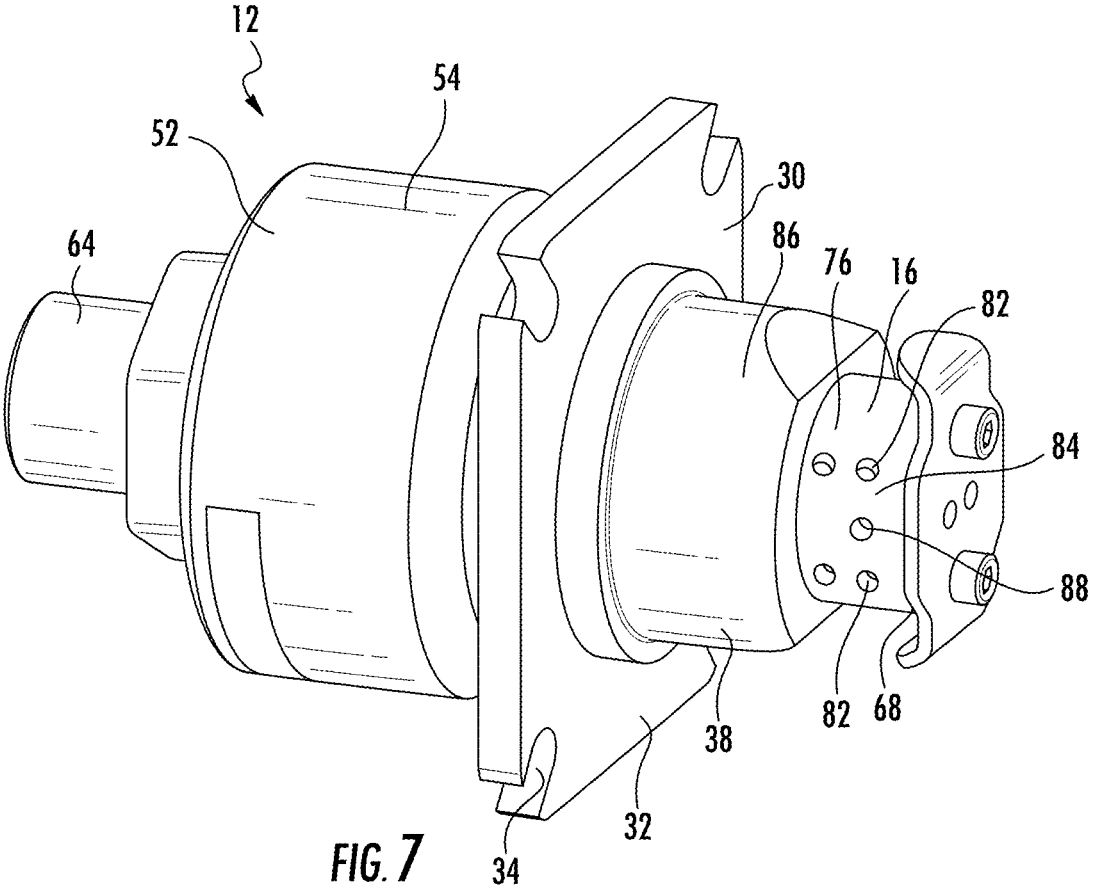

FIGS. 2, 4, and 6 illustrate an embodiment of the fire suppression unit 12 in a passive or inactive condition with the nozzle 16 in a retracted position (the nozzle 16 hidden from view in FIG. 6), while FIGS. 3, 5, and 7 illustrate an embodiment of the fire suppression unit 12 in an active condition, with the nozzle 16 in an extended position. Under normal circumstances, such as in an environment without fire, the fire suppression unit 12 is in the passive condition shown in FIGS. 2, 4, and 6. As shown in FIG. 4, in one application of the fire suppression unit 12, the fire suppression unit 12 is mounted on a surface 24 of the hood or duct 22, such as a galley duct of a marine vessel. The surface 24 separates a protected area 26, such as an interior of the duct 22, from an unprotected area 28, such as an exterior area of the duct 22. By "unprotected" it should be understood that while the area 28 is not protected by the suppression unit 12, the area 28 may be protected by other suppression units 12 or other devices not described herein. Also, the fire suppression unit 12 may be employed in other fields and applications other than marine galley ducts, such as, but not limited to, any industrial ventilation or material transport system, wood processing plants, coal power plants, bakeries, laundries (including marine laundry ducts), and anywhere air with small flammable particles is present and ventilated or transported using channels and air. Also, the protected area 26 may simply be a room, and the unprotected area 28 may be disposed behind a ceiling panel or wall. The surface 24 may thus represent any panel, wall, or surface upon which the fire suppression unit 12 is mounted.

The nozzle 16 is movably supported relative to the surface 24 by a casing 30 (cylinder body). The casing 30 includes a flange 32 having a plurality of securement receiving areas 34, such as grooves, holes, or apertures, for receiving a respective number of securement devices 36 (FIG. 4), such as screws, therethrough to secure the fire suppression unit 12 to the surface 24. The casing 30 further includes a body 38 having a longitudinal axis 40 and an interior main chamber 42 for receiving the nozzle 16 therein. Also received within the main chamber 42 is the actuator piston 14, which is also longitudinally movable within the casing 30, and biasing device 44, such as a compression spring, and in particular a stainless steel spring. An O-ring 46 may be disposed between the actuator piston 14 and the body 38, an O-ring 48 may be disposed between the nozzle 16 and the body 38, and an O-ring 50 may be disposed between the actuator piston 14 and the nozzle 16. An inlet portion 52 (otherwise referred to as a connection plug) is fixedly attached to the body 38. The actuator piston 14, O-ring 46, biasing device 44, inlet portion 52, and casing 30 cooperate together to form an actuator for the suppression unit 12. In one embodiment, the inlet portion 52 includes a body receiving section 54 concentrically surrounding a first portion 56 (an upstream portion) of the body 38, and thus may also be termed a "nut." The body receiving section 54 and the first portion 56 of the body 38 may include cooperating threads 58 for threadably engaging the body 38 within the inlet portion 52. The inlet portion 52 further includes a fluid passageway 60 defining a flow path for a fire suppression fluid 18 to pass in direction 62 from a fluid supply, such as water mist system 20 (FIG. 1), towards the actuator piston 14 and nozzle 16. The fluid passageway 60 may further extend along the longitudinal axis 40. The inlet portion 52 may include exterior threads 64 for connecting with a hose or pipe to connect to the fluid supply (such as water mist system 20).

The nozzle 16 includes a first end 66 and a second end 68. A filter 70 is positioned at the first end 66, and is operatively arranged to filter incoming fluid 18 from the fluid passageway 60 entering an interior bore 72 of the nozzle 16, such as through inlets 74, such as of a filter mesh. The filter 70 may include a filter plug covered with filter mesh as illustrated, however the filter 70 may be designed in an alternative matter, to filter the flow of fluid into an interior bore 72. The nozzle 16 also includes a nozzle body 76 having a first end 78 and a second end 80 (corresponding to the second end 68 of the nozzle 16) and an interior bore 72, the interior bore 72 also extending along the longitudinal axis 40. Adjacent the second end 80 of the nozzle body 76 is at least one discharge orifice 82 that passes through the nozzle body 76 from the interior bore 72 to an exterior surface 84 of the nozzle body 76 (see FIG. 3). A plurality of discharge orifices 82 is illustrated, and is disposed in a discharge area 88 of the nozzle body 76. Thus, fluid 18 from the fluid passageway 60 enters the interior bore 72 via the inlets 74 and then exits the interior bore 72 via the discharge orifices 82.

As is evident from FIGS. 2, 4, and 6, fluid may not freely exit the discharge orifices 82 when the second end 68 of the nozzle 16, including the discharge area 88 of the nozzle body 76, is disposed within the main chamber 42 of the casing 30. In the passive condition shown in FIGS. 2, 4, and 6, a protection portion 86 of the casing 30 covers the discharge orifices 82. In one embodiment, an inner diameter of the protection portion 86 may be substantially the same as an outer diameter of the discharge area 88, such that the protection portion 86 forms a close fit sleeve/sheath that covers and protects the discharge orifices 82 in the passive condition. The discharge area 88 may thus, in one embodiment, be provided with a substantially constant outer diameter for this purpose.

Using fluid pressure, the actuator piston 14 moves the nozzle 16 from the passive condition shown in FIGS. 2, 4, and 6, to the active condition shown in FIGS. 3, 5, and 7. The actuator piston 14 receives the nozzle 16 therein, such as by threaded engagement between exterior threads 90 on the exterior surface 84 of the nozzle body 76 and interior threads 92 on an interior surface 94 of the actuator piston 14. A second end 96 of the actuator piston 14 may further abut with a shoulder 98 on the nozzle body 76 of the nozzle 16 for assisting in proper assembly between the actuator piston 14 and the nozzle 16. The shoulder 98 is a section of the nozzle body 76 that has a larger diameter than the section of the nozzle body 76 that includes the exterior threads 90. Due in part to the second end 96 in abutment with the shoulder 98, a spring chamber 100, in receipt of the biasing device 44, is separated from the interior bore 72 of the nozzle 16 and interior channel 102 of the actuator piston 14 by the actuator piston 14 and the nozzle 16. The O-ring 50 may be positioned between the second end 96 of the actuator piston 14 and the shoulder 98 of the nozzle 16. The O-ring 46 may be positioned between a first end 104 of the actuator piston 14 and the body 38 of the casing 30. The interior channel 102 of the actuator piston 14, in which the nozzle 16 is received, may include a frustoconical tapered portion 106 for guiding fluid towards the nozzle 16. An annulus 108 may further be disposed between the interior surface 94 of the actuator piston 14 and the filter 70. The annulus 108 ends at the threaded connection between exterior threads 90 and interior threads 92 between the actuator piston 14 and the nozzle 16. Fluid that wells up in the annulus 108 may then find way into the inlets 74 and the interior bore 72 of the nozzle body 76.

The spring chamber 100 between the body 38 of the casing 30 and the actuator piston 14/nozzle 16 encloses the biasing device 44, such as the illustrated spring, therein. The biasing device 44 includes a first end 110 that abuts with a shoulder 112 on an exterior surface 114 of the actuator piston 14, and a second end 116 that abuts with a shoulder 118 on an interior surface 120 of the body 38. The shoulder 118 on the interior surface 120 of the body 38 is disposed upstream of the discharge orifices 82, even in the passive condition, and thus the biasing device 44 is shielded from moisture from the discharge orifices 82, as well as shielded from moisture from the fluid passageway 60 of the inlet portion 52 and the interior channel 102 of the actuator piston 14. The shoulder 118 faces the shoulder 112. The shoulder 112 is spaced a first distance from the shoulder 118 in the passive condition shown in FIGS. 2, 4, 6, and the shoulder 112 moves closer to the shoulder 118 to be spaced a second distance smaller than the first distance in the active condition shown in FIGS. 3, 5, 7. As the casing 38 is fixedly supported on the surface 24, the actuator piston 14 is responsible for moving the shoulder 112 closer to the shoulder 118 and compressing the biasing device 44 there between. Thus, the actuator piston 14 serves as a piston within the suppression unit 12. Activation of the actuator piston 14 to compress the biasing device 44 occurs upon receipt of fluid pressure from the fluid passageway 60 of the inlet portion 52 into the interior channel 102 of the actuator piston 14. The increasing pressure within the interior channel 102 will force the actuator piston 14 in the direction 62, and force the nozzle 16 in direction 62. When the nozzle 16 is moved longitudinally to the extended position, the discharge orifices 82 are moved longitudinally past the protection portion 86 of the casing 30. In this active condition, the discharge orifices 82 are fluidically communicable with the protected area 26. That is, the discharge orifices 82 are no longer protected by the body 38 of the casing 30. The O-ring 48 may remain within the protection portion 86 to retain the seal between the exterior surface 84 of the nozzle body 76 and the protection portion 86 of the body 38 of the casing 30, such that fluid dispersed into protected area 26 is blocked from entry between the nozzle body 76 and the casing body 38. When the fluid pressure is removed, the reduced pressure on actuator piston 14 will allow the biasing device 44 to extend in direction 63 and push on shoulder 112 of the actuator piston 14 such that the actuator piston 14 will move in direction 63, thus retracting the nozzle 16 back within the casing 30.

While previously a nozzle and piston have been manufactured as one part, in the embodiments described herein the nozzle 16 can be manufactured independently from the actuator piston 14. Due to the exterior threads 90 provided on the nozzle 16, the nozzle 16 can be independently utilized in different applications, such as a stand-alone nozzle not requiring extension and retraction (i.e., without the casing 30 and actuator piston 14), and thus the nozzle 16 can be independently tested as a nozzle. Also, when the nozzle 16 is employed in suppression unit 12, when features and/or dimensions of the actuator piston 14 and/or casing 30 are altered to suit different applications, the design and dimensions of the nozzle 16 need not be altered, thus reducing the complexity of the nozzle component. As long as the nozzle 16 remains the same, additional expensive and time consuming testing procedures on the nozzle 16 may be eliminated. The nozzle 16 thus serves as a modular component usable in a variety of suppression units 12, as well as a stand-alone unit. That is, the construction allows use of the type approved nozzle 16 with the actuator piston 14 in the suppression unit 12, and allows use of the type approved nozzle 16 as an independent spray head in conventional applications where protection of the discharge orifices 82 is not required. From a manufacturer perspective, it is beneficial to have a single type approved component instead of two. Further, because the nozzle 16 does not include the biasing device 44 in its construction, the nozzle 16 can be separately tested in tests limited to a nozzle.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the spirit and scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. A nozzle comprising:

a nozzle body having a first end and a second end, an exterior surface, an interior bore extending along a longitudinal axis, a shoulder, a plurality of discharge orifices passing from the interior bore to the exterior surface in a cylindrical discharge area of the nozzle body, the plurality of discharge orifices terminating at the exterior surface in the cylindrical discharge area, the cylindrical discharge area disposed between the second end and the shoulder, and a threaded area on the exterior surface, the threaded area disposed between the first end and the shoulder; and, a filter at the first end of the nozzle body, the filter including inlets to the interior bore;

wherein the exterior surface in the cylindrical discharge area has a constant outer diameter along the longitudinal axis;

wherein the shoulder has the same outer dimension diameter along an entire circumference as an outer dimension diameter along an entire circumference of the cylindrical discharge area, wherein the shoulder is spaced from the cylindrical discharge area by a gap having a gap outer diameter less than the outer diameter of the shoulder.

2. The nozzle according to claim 1, further comprising a circumferential O-ring receiving indent in the nozzle body between the shoulder and the cylindrical discharge area.

3. The nozzle according to claim 1, further comprising an O-ring receiving area on the exterior surface of the nozzle body between the shoulder and the threaded area.

4. The nozzle according to claim 1, wherein the shoulder has an outer dimension greater than an outer dimension of the threaded area.

* * * * *